United States Patent [19]

Kreitner et al.

[11] 4,421,642

[45] Dec. 20, 1983

[54] DEVICE FOR SEPARATING GRINDING MEDIUM AND MILLED SUSPENSION IN A WET COMMINUTING MACHINE

[75] Inventors: Ludwig Kreitner, Heppenheim; Juergen Klapper, Maxdorf; Horst Schober, Otterberg, all of Fed. Rep. of Germany

[73] Assignee: BASF Aktiengesellschaft, Fed. Rep. of Germany

[21] Appl. No.: 343,761

[22] Filed: Jan. 28, 1982

[30] Foreign Application Priority Data

Feb. 4, 1981 [DE] Fed. Rep. of Germany ..... 3103662

[51] Int. Cl.[3] ..... B07B 1/52

[52] U.S. Cl. ..... 209/384; 241/70; 241/166; 15/246

[58] Field of Search ..... 209/379, 384, 387; 210/413; 241/166, 70; 15/246

[56] References Cited

U.S. PATENT DOCUMENTS

| | | | |
|---|---|---|---|
| 65,504 | 6/1867 | Pryor | 241/166 |
| 1,279,335 | 9/1918 | Harding | 241/70 |
| 3,567,032 | 3/1971 | Kemper | 210/413 |
| 3,972,813 | 8/1976 | Ziokowski | 209/384 |

FOREIGN PATENT DOCUMENTS 2446341 4/1975 Fed. Rep. of Germany .

*Primary Examiner*—Bernard Nozick
*Attorney, Agent, or Firm*—Keil & Witherspoon

[57] ABSTRACT

A wet comminuting machine is provided with a sieve which is located at the mill base outlet and has orifices of such dimensions that they block the passage of grinding medium. Opposite the exit surface of the sieve a plate, which can be moved toward the sieve, is provided, on the side facing the sieve, with elements for pushing through the orifices of the sieve, and can be moved manually, pneumatically, hydraulically or electrically by means of a connecting rod. The elements of the movable plate are arranged in alignment with the orifices of the sieve, and are in the form of strips or spikes, depending on the particular design of sieve.

3 Claims, 1 Drawing Figure

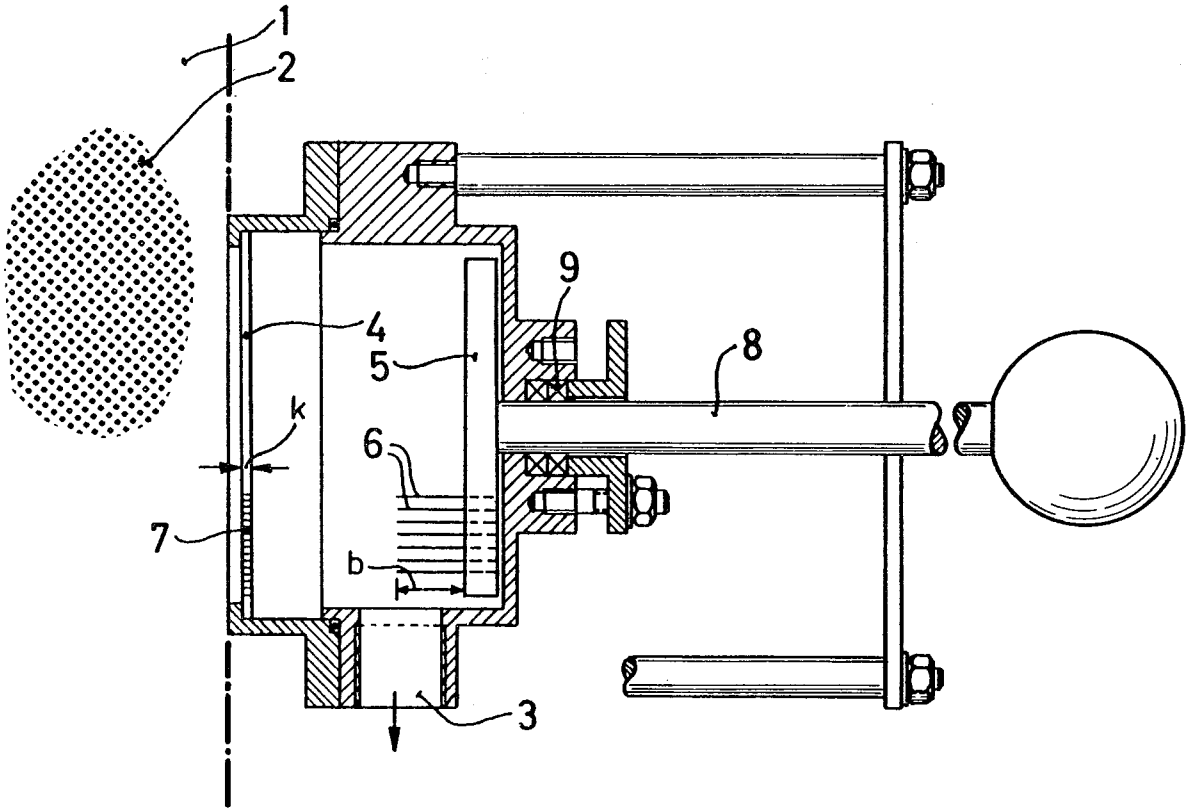
1
2
4
5
6
b
h
k
7
9
8
3

DEVICE FOR SEPARATING GRINDING MEDIUM AND MILLED SUSPENSION IN A WET COMMINUTING MACHINE

The present invention relates to a device for separating grinding medium from milled suspension in a wet comminuting machine, having a sieve which is located at the mill base outlet of the machine and has orifices of such dimensions that they block the passage of grinding medium.

It is known, for example from German Published Application DAS 2,446,341, that wet comminuting machines substantially filled with grinding medium, for example agitator mills, ball mills or tube mills, may be used to disperse pigments. After dispersing, the milled suspension must be separated from the grinding medium, and this is done by means of slit sieves or slotted plates, the holes or slots being smaller than the grinding medium, so that the milled suspension flows through the holes or slots, while the grinding medium is retained. Since the slit width is about $\frac{1}{3}$ of the diameter of the grinding medium employed, the use of a very fine grinding medium, with, for example, a particle diameter of 0.8 mm, requires correspondingly narrow slit widths, for example of 0.25 mm. Hitherto, the running time of such slit sieves has been very short—often only a few hours—since the sieves rapidly become blocked by abraded and broken grinding medium particles and, in the case of some products, even by large particles. This in turn always means opening the machine, taking out, cleaning and refitting the slit sieve and closing the machine again.

It is an object of the present invention to provide a separating device in which clogged sieves can rapidly and satisfactorily be cleaned during continuous operation of the wet comminuting machine.

We have found that this object is achieved, according to the invention, if a plate which can be moved towards the sieve is located opposite the exit surface of the sieve and carries, on the side facing the sieve, elements for pushing through the orifices of the sieve, the elements being located in alignment with the orifices of the sieve. The plate can be moved manually, pneumatically, hydraulically or electrically by means of a connecting rod. If the sieve is a slit sieve, the elements of the plate opposite the sieve are sheet-metal strips.

An embodiment of the invention is explained in more detail below in relation to the drawing, which shows a section through the milling chamber and through the slit sieve of an agitator mill, as well as through the plate which is opposite the sieve and into which are set narrow, fixed sheet-metal strips.

As shown in the drawing, milled suspension and grinding medium 2 are present in the interior of the milling chamber 1 of an agitator mill. The milled suspension leaves the chamber via the mill base outlet 3. At the outlet is located a flat sieve 4, in the form of a slit sieve, the slit widths being about $\frac{1}{3}$ of the grinding medium particle diameter. This sieve 4 separates the grinding medium 2 from the suspension leaving the milling chamber 1, and retains the grinding medium. Small particles, of approximately the same size as the slit widths of the flat sieve and consisting of abraded and broken grinding medium as well as of product particles, can deposit in the sieve and thereby reduce the free sieve surface. This often has the effect that the flat sieve is clogged after only a few hours. To prevent this clogging of the sieve, a plate 5 which can be moved towards the sieve is located opposite the exit surface of the sieve. Narrow fixed sheet-metal strips 6, which are aligned with, and opposite, the orifices 7 of the sieve 4, are set in this plate. In the event of clogging, the sheet-metal strips are pushed through the orifices 7 of the flat sieve. This returns the clogging particles into the milling chamber and increases the free sieve area. The plate 5 is moved by means of a connecting rod 8. A seal 9 prevents suspension exuding from the orifice through which the rod passes. When the flat sieve becomes clogged again, the above sequence can be repeated periodically, as required. In the embodiment discussed, the movable plate is made of metal and the sheet-metal strips are welded to the plate. The thickness of the strips is slightly less than the size of the orifices in the flat sieve. The dimension "b" of the strips is greater than the thickness "k" of the sieve. Alternatively, the sieve can be a plate perforated with holes, in which case the sheet-metal strips in the movable plate are replaced by spikes.

The advantage achieved by means of the invention is that the slit sieve can be rapidly and satisfactorily cleaned from the outside, during continuous operation, thereby dispensing with expensive cleaning work and substantially increasing the length of time for which the wet comminuting machine can be run.

We claim:

1. A device for separating grinding medium from milled suspension in a wet comminuting machine, having a sieve which is located at the mill base outlet of the machine and has orifices of such dimensions that they block the passage of grinding medium, wherein said outlet comprises a plate which carries, on the side facing the sieve, elements arranged in alignment with the orifices of the sieve, said plate and said elements being normally in a location opposite, but remote from, the exit face of said sieve, and means being provided for mounting said plate for reciprocating movement towards and away from said sieve to permit said elements to be pushed, intermittently, through the orifices of the sieve for cleaning said orifices.

2. A separating device as claimed in claim 1, wherein said means include a connecting rod for manually, pneumatically, hydraulically or electrically moving said plate.

3. A separating device as claimed in claim 1 or 2, wherein the sieve is a slit sieve and the elements of the movable plate located opposite the slit sieve are sheet-metal strips.

* * * * *